US007446085B2

(12) United States Patent
Imaizumi et al.

(10) Patent No.: US 7,446,085 B2
(45) Date of Patent: Nov. 4, 2008

(54) PROCESS FOR PREPARING DETERGENT PARTICLES

(75) Inventors: Yoshinobu Imaizumi, Wakayama (JP); Hiroyuki Yamashita, Wakayama (JP); Teruo Kubota, Wakayama (JP)

(73) Assignee: Kao Corporation, Tokyo (JP)

( * ) Notice: Subject to any disclaimer, the term of this patent is extended or adjusted under 35 U.S.C. 154(b) by 226 days.

(21) Appl. No.: 10/523,606

(22) PCT Filed: Sep. 2, 2003

(86) PCT No.: PCT/JP03/11192

§ 371 (c)(1),
(2), (4) Date: Feb. 4, 2005

(87) PCT Pub. No.: WO2004/022688

PCT Pub. Date: Mar. 18, 2004

(65) Prior Publication Data

US 2005/0256023 A1 Nov. 17, 2005

(30) Foreign Application Priority Data

Sep. 6, 2002 (JP) ..... 2002-261686

(51) Int. Cl.
*C11D 11/00* (2006.01)

(52) U.S. Cl. ..... 510/443; 510/444; 510/452; 510/276

(58) Field of Classification Search ..... 510/443, 510/444, 452, 276
See application file for complete search history.

(56) References Cited

U.S. PATENT DOCUMENTS

| | | | | | |
|---|---|---|---|---|---|
| 4,129,526 | A * | 12/1978 | Ogoshi et al. | ..... | 510/443 |
| 4,734,224 | A * | 3/1988 | Barrett et al. | ..... | 510/357 |
| 4,826,632 | A * | 5/1989 | Blackburn et al. | ..... | 510/351 |
| 5,164,108 | A | 11/1992 | Appel et al. | | |
| 5,282,996 | A * | 2/1994 | Appel et al. | ..... | 510/446 |
| 5,527,489 | A * | 6/1996 | Tadsen et al. | ..... | 510/294 |
| 5,573,697 | A * | 11/1996 | Riddick et al. | ..... | 510/359 |
| 5,616,550 | A | 4/1997 | Kruse et al. | | |
| 5,668,099 | A * | 9/1997 | Chapman et al. | ..... | 510/444 |
| 5,736,501 | A | 4/1998 | Yamashita et al. | | |
| 5,821,207 | A * | 10/1998 | Kanai et al. | ..... | 510/531 |
| 5,945,395 | A | 8/1999 | Yamashita et al. | | |
| 6,063,751 | A * | 5/2000 | France et al. | ..... | 510/444 |
| 6,258,773 | B1 * | 7/2001 | Mort et al. | ..... | 510/444 |
| 6,376,453 | B1 * | 4/2002 | Kubota et al. | ..... | 510/438 |
| 6,528,474 | B1 | 3/2003 | Artiga Gonzalez et al. | | |
| 6,849,590 | B1 * | 2/2005 | Yamaboshi et al. | ..... | 510/441 |
| 6,864,221 | B1 * | 3/2005 | Takana et al. | ..... | 510/438 |
| 6,992,055 | B1 * | 1/2006 | Nitta et al. | ..... | 510/444 |
| 7,053,038 | B2 * | 5/2006 | Groot et al. | ..... | 510/444 |
| 7,098,177 | B1 * | 8/2006 | Kubota et al. | ..... | 510/444 |
| 2002/0155977 | A1 | 10/2002 | Kubota et al. | | |

FOREIGN PATENT DOCUMENTS

| | | | |
|---|---|---|---|
| DE | 19529298 | A1 | 2/1996 |
| DE | 19822941 | A1 | 11/1999 |
| DE | 19936613 | A1 | 2/2001 |
| EP | 0221776 | A2 | 5/1987 |
| EP | 0266863 | A1 | 5/1988 |
| EP | 0352135 | A1 | 1/1990 |
| EP | 0438320 | A2 | 7/1991 |
| EP | 0544365 | A1 | 6/1993 |
| EP | 0936269 | A1 | 8/1999 |
| EP | 0 969 082 | A | 1/2000 |
| EP | 0969082 | A1 | 1/2000 |
| EP | 1104803 | A1 | 6/2001 |
| WO | WO-93/23523 | A1 | 11/1993 |
| WO | WO-01/48058 | A1 | 7/2001 |

* cited by examiner

*Primary Examiner*—Lorna M Douyon
(74) *Attorney, Agent, or Firm*—Birch, Stewart, Kolasch & Birch, LLP

(57) ABSTRACT

Detergent particles obtained by a process comprising the step of dryneutralizing base particles comprising a water-soluble solid alkali inorganic substance (A) with a liquid acid precursor (B) of a non-soap anionic surfactant, wherein the base particles are obtained by a spray-drying method, and wherein the base particles contain the component (A) in an amount of equal to or greater than 4 times the amount equivalent for neutralizing the component (B) and have an average particle size of from 150 to 400 μm; base particles having an average particle size of from 150 to 400 μm, comprising 20 to 80% by weight of a water-soluble solid alkali inorganic substance; a process for preparing detergent particles comprising the steps of (a) preparing a slurry comprising a water-soluble solid alkali inorganic substance (A) in an amount equal to or greater than 4 times the amount equivalent for neutralizing a liquid acid precursor (B) of a non-soap anionic surfactant to be added in step (c); (b) spray-drying the slurry obtained in step (a) to give base particles; and (c) mixing the liquid acid precursor (B) with the base particles obtained in step (b) and dry-neutralizing the resulting mixture; and a detergent composition comprising the detergent particles as defined above. The detergent particles can be used for laundry detergents, dishwashing detergents and the like.

5 Claims, 1 Drawing Sheet

PROCESS FOR PREPARING DETERGENT PARTICLES

TECHNICAL FIELD

The present invention relates to detergent particles, a process for preparing the detergent particles, base particles, and a detergent composition comprising the detergent particles. More specifically, the present invention relates to detergent particles used for washing laundry items and the like, a process for preparing the detergent particles, base particles, and a detergent composition comprising the detergent particles.

BACKGROUND ART

Many detergents comprising an anionic surfactant, such as an alkylbenzenesulfonate, as a main component have been prepared from the viewpoints of economic advantage, foaming property and the like. As a process for preparing the detergent particles as mentioned above, there has been employed a process in which an acid precursor of the above anionic surfactant is in situ dry-neutralized with a water-soluble solid alkali inorganic substance, such as sodium carbonate, instead of directly adding the surfactant.

For instance, a process of producing a detergent composition comprising the steps of dry-neutralizing components in a high speed mixer and/or granulator at a temperature of 55° C. or less, and thereafter adding a liquid binder thereto to carry out granulation (see Japanese Patent Laid-Open No. Hei 3-33199); a process of producing a detergent composition comprising the steps of dry-neutralizing components in a high speed mixer and/or granulator at a temperature of 55° C. or more, and then adding a liquid binder thereto to carry out granulation (see Japanese Patent Laid-Open No. Hei 4-363398); and a process of producing a detergent composition comprising dry-neutralizing components in a continuous-type high-speed mixer and then increasing the bulk density with a moderate-speed mixer, and subsequently cooling and/or drying the product to form into granules (see Japanese Patent Laid-Open No. Hei 3-146599) have been disclosed.

However, when the detergent particle is produced by these processes, in order to suppress the particle from being aggregated and/or becoming coarse due to the adhesive property of the anionic surfactant produced by the neutralization, it is necessary to keep its granular shape by operating the agitation mechanism for mixing and the cutting mechanism for disintegration and/or dispersion at high speeds. In this case, the detergent particle having a desired small particle size can be prepared by optimizing the agitation and/or cutting conditions. However, it would be difficult to efficiently obtain the detergent particle, and the particle size distribution of the resulting particle would become wider.

As a process for eliminating these problems, a method for preparing a detergent particle having a small particle size at a high yield in which the adhesive property of the anionic surfactant can be suppressed by containing an inorganic acid in the acid precursor and the content of the anionic surfactant can be increased (see WO 98/10052). However, there have yet remain the problems of disintegrating the aggregate by agitation and/or cutting and making the particle size smaller, so that there are much room for improvement in the efficiency and the obtainment of a sharper particle size distribution.

As mentioned above, the process according to dry-neutralization is suitable for conveniently preparing detergent particles comprising an anionic surfactant as a main component. In the conventional process, the process is basically carried out by granulating raw materials with disintegrating, thereby making it difficult to efficiently obtain detergent particles having a sharp particle size distribution in a relatively small particle size range.

In addition, with regard to the dissolubility, according to the conventional process as described above, the detergent particles comprise non-hollow particles having a structure in which solid particles are connected by a large continuous layer of the anionic surfactant. Therefore, it would not be easy to improve the dissolubility.

Having a sharp particle size distribution in the detergent has an advantage of not only giving excellent external appearance but also improving its flowability. Also, a detergent comprising an anionic surfactant as a main component may be used for handwashing in many cases, so that the users' convenience is improved by increasing the dissolubility. Therefore, a sharper particle size distribution and more improved dissolubility have been desired in detergent particles comprising an anionic surfactant as a main component obtained by dry-neutralization.

An object of the present invention is to provide detergent particles having excellent storage stability, dissolubility and sharp particle size distribution, a process for preparing the detergent particles, base particles and a detergent composition comprising the detergent particles.

These and other objects of the present invention will be apparent from the following description.

DISCLOSURE OF INVENTION

Accordingly, there are provided:

[1] detergent particles obtained by a process comprising the step of dry-neutralizing base particles comprising a water-soluble solid alkali inorganic substance (A) with a liquid acid precursor (B) of a non-soap anionic surfactant, wherein the base particles are obtained by a spray-drying method, and wherein the base particles contain the component (A) in an amount of equal to or greater than 4 times the amount equivalent for neutralizing the component (B) and have an average particle size of from 150 to 400 μm;

[2] base particles having an average particle size of from 150 to 400 μm, comprising 20 to 80% by weight of a water-soluble solid alkali inorganic substance;

[3] a process for preparing detergent particles comprising the steps of:

(a): preparing a slurry comprising a water-soluble solid alkali inorganic substance (A) in an amount equal to or greater than 4 times the amount equivalent for neutralizing a liquid acid precursor (B) of a non-soap anionic surfactant to be added in step (c);

(b): spray-drying the slurry obtained in step (a) to give base particles; and (c): mixing the liquid acid precursor (B) with the base particles obtained in step (b) and dry-neutralizing the resulting mixture; and

[4] a detergent composition comprising the detergent particles as defined in the above [1].

BRIEF DESCRIPTION OF THE DRAWINGS

In FIG. 1, the cross sections of the external portion, and the surface portion and the inner portion of the base particle are sequentially shown from the left. It can be seen that fine particles are formed in the inner portion of the base particle in a large number.

BEST MODE FOR CARRYING OUT THE INVENTION

Figure 1:
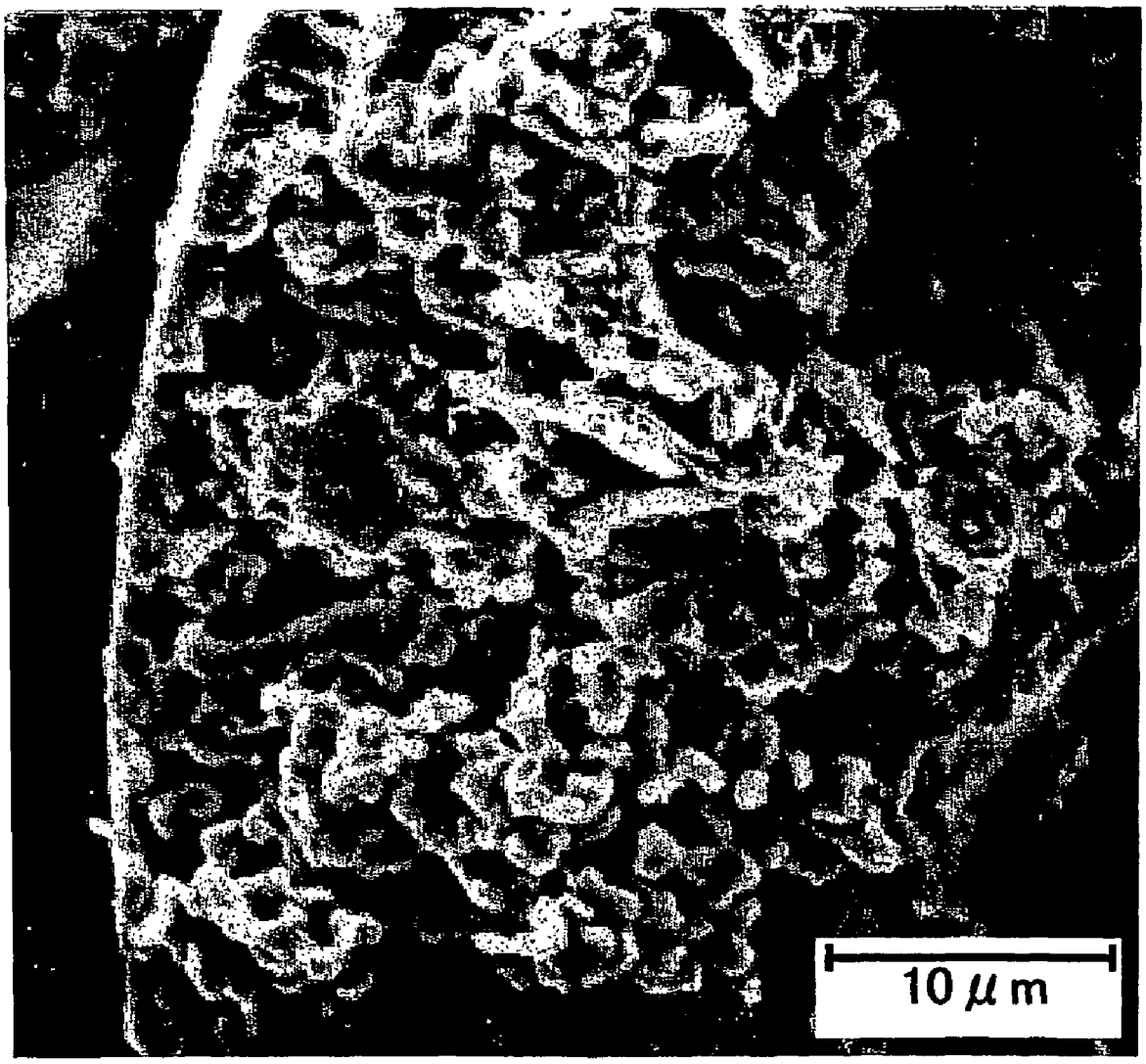
FIG. 1 shows an SEM image of a cross section of the base particle obtained in Example 1.

The detergent particles of the present invention, as described above, are detergent particles obtained by a process comprising the step of dry-neutralizing base particles comprising a water-soluble solid alkali inorganic substance (A), with a liquid acid precursor (B) of a non-soap anionic surfactant, wherein the base particles are obtained by a spray-drying method, wherein the base particles contain the component (A) in an amount of equal to or greater than 4 times the amount equivalent for neutralizing the component (B) and have an average particle size of from 150 to 400 μm.

In the present invention, since the above detergent particles are used, the water-soluble solid alkali inorganic substance is contained in a fine shape in the base particle in an amount far exceeding the amount equivalent for neutralization and the reactive area is increased by making the particle size of the base particle itself smaller, so that the dry-neutralization is carried out on the surface of the base particle with a fast reaction rate. Therefore, the detergent particles can take a structure in which the base particle is coated with a non-soap anionic surfactant. Therefore, there are exhibited some effects that the particle size distribution of the detergent particle has a sharp particle distribution on the basis of the base particles obtained by a spray-drying method and that the yield of the detergent particles is also dramatically improved. In addition, with regard to the dissolubility, a larger continuous phase is less likely to formed due to the reaction of the non-soap anionic surfactant with the fine water-soluble solid alkali inorganic substance, and the anionic surfactant is thinly spread in a filmy state near the surface. Therefore, the dissolution surface area is larger, thereby exhibiting an effect of an excellent dissolubility.

Furthermore, since the detergent particles have a structure in which the base particle is coated with the non-soap anionic surfactant, effects that stabilities during storage such as bleed-out and caking property are dramatically improved are exhibited.

The term "detergent particle" in the present invention refers to a particle comprising a base particle, a surfactant and the like, and the term "detergent particles" means an aggregate thereof. Also, the detergent composition mentioned later means a composition comprising the detergent particles and separately added deterging components other than the detergent particles, such as fluorescers, enzymes, perfumes, defoaming agents, bleaching agents and bleaching activators.

<Composition for Base Particles>

The "base particle" constituting the detergent particle contained in the detergent particles of the present invention comprises the component (A), which is used for dry-neutralizing with the component (B), and the base particle is a particle obtained by a spray-drying method. An aggregate thereof is referred to as "base particles."

1. Component (A): Water-Soluble Solid Alkali Inorganic Substance

The term "water-soluble solid alkali inorganic substance" of the component (A) refers to an alkali inorganic substance which is solid at an ambient temperature, and one which can be dissolved in water in an amount of 1 g or more in 100 g of water at 20° C. is preferable. The water-soluble solid alkali inorganic substance is not particularly limited, and alkali metal salts, silicates and the like having hydroxyl group, carbonate group, or hydrogencarbonate group can be used. The water-soluble solid alkali inorganic substance includes, for instance, sodium hydroxide, sodium carbonate, sodium hydrogencarbonate, potassium carbonate, sodium silicate and the like. Among them, sodium carbonate is preferable as an alkalizing agent showing suitable pH buffering range in a washing liquid. Also, the formulation of sodium hydroxide is also effective from the viewpoint of the reaction rate during the dry-neutralization.

In the present invention, it is preferable that the component (A) exists in as fine state as possible in the base particles. For instance, the size of the component (A) is such that its average particle size is preferably from 0.1 to 50 μm. The state of this particle can be confirmed by direct observation with the SEM.

In the present invention, when the detergent particles are prepared by using the base particles comprising fine particles of the component (A), the dry-neutralization can be carried out without applying high cutting power as conventionally required when the above base particles are mixed with a liquid acid precursor (B) of a non-soap anionic surfactant, so that the base particle undergoes little disintegration, whereby the resulting detergent particle has little change in the particle growth of the base particle. Therefore, the particle size distributions of the base particles and the detergent particles become sharp. Accordingly, there is an advantage that a detergent particle having low bulk density, excellent storage stability and dissolubility and sharp particle size distribution can be efficiently obtained.

As to the amount of the component (A), in addition to the amount necessary from the viewpoint of detergency performance, an amount necessary for dry-neutralization of the component (A) with the liquid acid precursor (B) of a non-soap anionic surfactant to be mixed in step (c) must be formulated. Further, it is necessary that the reaction of the component (A) with the component (B) is accelerated on the surface of the detergent particle. Therefore, it is necessary that the amount of the component (A) is 4 times or more, preferably 6 times or more, of the amount equivalent for neutralizing the component (B). Concretely, the amount of the component (A) is preferably from 20 to 80% by weight, more preferably from 25 to 70% by weight, still more preferably from 30 to 60% by weight, of the base particles, from the viewpoints of reaction rate and degree of freedom in the formulation.

In addition, the amount of the component (A) is preferably 10% by weight or more, more preferably 15% by weight or more, of the detergent particles from the viewpoint of detergency performance. On the other hand, the amount of the component (A) is at least the amount equivalent for neutralizing the liquid acid precursor (B) from the viewpoint of dry-neutralization. Therefore, the formulation amount is preferably equal to or greater than the sum of these two values.

An essential component for the base particles in the present invention is only the water-soluble solid alkali inorganic substance (A), and other components usually used in the detergent particles can be optionally simultaneously formulated in the base particles in proper amounts, from the viewpoints of the detergency performance, the particle size distribution and the particle strength. The other components include a chelating agent, a water-soluble inorganic salt, a (water-soluble) polymer, a surfactant, a water-insoluble excipient, other auxiliary components and the like. Among them, it is preferable that the chelating agent, the water-soluble inorganic salt, the (water-soluble) polymer and the surfactant are formulated. Concrete examples of these components are given hereinbelow.

2. Chelating Agent

The chelating agent can be formulated in the base particles in order to suppress the inhibition of deterging action by metal ions, and examples thereof are water-soluble chelating agents and water-insoluble chelating agents.

As the amount of the chelating agent, it is desired that the amount of the chelating agent formulated in the base particle is adjusted so that the content of the chelating agent is preferably from 3 to 60% by weight, more preferably from 5 to 40% by weight, still more preferably from 10 to 40% by weight, of the detergent particles, from the viewpoint of metal ion capturing ability. A plural chelating agents can be simultaneously formulated, in which case it is desired that its total content is as specified above.

The water-soluble chelating agent is not particularly limited as long as the water-soluble chelating agent is a substance having a metal ion capturing ability, and tripolyphosphate, orthophosphate, pyrophosphate and the like can be used. Among them, tripolyphosphate is preferable, and its content is preferably 60% by weight or more, more preferably 70% by weight or more, still more preferably 80% by weight or more, of the entire water-soluble chelating agents. Also, as the counter ion, an alkali metal ion is preferable, and especially sodium ion and/or potassium ion is preferable.

The water-insoluble chelating agent may be added to the base particles for the purposes of improving the metal ion capturing ability and enhancing the strength of the base particle. Those having an average particle size of from 0.1 to 20 μm are preferable from the viewpoint of the dispersibility in water. Preferable base materials include crystalline aluminosilicates, including, for instance, A-type zeolite, P-type zeolite, X-type zeolite and the like. The A-type zeolite is preferable from the viewpoints of the metal ion capturing ability and economic advantages.

As to the amount of the zeolite formulated, when the zeolite is formulated in a large amount, there is a possibility that the zeolite decomposes during the dry-neutralization reaction. Therefore, it is preferable that the amount of the zeolite is controlled to 10% by weight or less of the base particles. Also, for the purpose of suppressing the decomposition, the amount of zeolite formulated can be increased by using the zeolite together with a water-soluble alkalizing agent having high dissolubility and high alkali strength, such as sodium hydroxide.

3. Water-Soluble Inorganic Salt

It is preferable that the water-soluble inorganic salt is formulated in the base particles in order to enhance the ionic strength of the washing liquid and improve the effects of sebum stain deterging and the like. The water-soluble inorganic salt is not particularly limited as long as the water-soluble inorganic salt is a substance having an excellent dissolubility and not giving worsening effect to detergency. The water-soluble inorganic salt includes, for instance, an alkali metal salt or ammonium salt having sulfate group or sulfite group, and the like. Among them, it is preferable that sodium sulfate, sodium chloride, sodium sulfite or potassium sulfate having high degree of ionic dissociation is used as an excipient. Also, its combined use with magnesium sulfate is also effective from the viewpoint of improving the dissolution speed.

The amount of the water-soluble inorganic salt is preferably from 5 to 80% by weight, more preferably from 10 to 70% by weight, still more preferably from 20 to 60% by weight, of the base particles, from the viewpoint of the ionic strength.

4. (Water-Soluble) Polymer

The water-soluble polymer may be added to the base particles for the purposes of enhancing the particle strength by adjustment of precipitation of crystals and film formation on the base particles. The water-soluble polymer includes organic polymers and inorganic polymers. For instance, the organic polymer includes carboxylate polymers, carboxymethyl cellulose, soluble starches, saccharides, polyethylene glycol and the like, and the inorganic polymer includes amorphous silicates and the like. Among them, the carboxylate polymers are preferable, among which a salt of an acrylic acid-maleic acid copolymer and a polyacrylate (counter ions: Na, K, $NH_4$ and the like) are especially preferable. Those carboxylate polymers having a molecular weight of from 1000 to 8000 are preferable, and those having a molecular weight of 2000 or more and 10 or more carboxylate groups are more preferable. The amount of the organic polymer is preferably from 0.1 to 10% by weight, more preferably from 0.5 to 5% by weight, of the base particles.

In addition, it is preferable that the organic polymer is used together with the inorganic polymer such as amorphous silicates, from the viewpoint of enhancing the particle strength, especially No. 2 sodium silicate is preferable. The amount of the inorganic polymer is preferably 15% by weight or less, more preferably 10% by weight or less, still more preferably 5% by weight or less, of the base particles, from the viewpoint of the dissolubility.

5. Surfactant

The surfactant may be added for the purpose of controlling the bulk density. For instance, a linear sodium alkylbenzenesulfonate, a sodium alkylsulfonate, sodium ether sulfonate, sodium paratoluenesulfonate, sodium xylenesulfonate, sodium cumenesulfonate, or the like can be used. Especially, the linear sodium alkylbenzenesulfonate is preferable from the viewpoint of economic advantages.

The amount of the surfactant is preferably 0.05% by weight or more, more preferably 0.1% by weight or more, of the base particles, from the viewpoint of controlling the bulk density. On the other hand, the amount of the surfactant is preferably 10% by weight or less, more preferably 5% by weight or less from the viewpoint of the dissolubility.

In addition, these surfactants can be added in the form of liquid acids, not neutralized form. In this case, it is preferable that the alkalizing agent is added in an amount equal to or greater than the amount equivalent for neutralizing the liquid acid, and the addition of sodium hydroxide is especially preferable.

6. Water-Insoluble Excipient

The water-insoluble excipient is not particularly limited as long as the water-insoluble excipient has excellent dispersibility in water and does not give worsening effects to detergency. The water-insoluble excipient includes, for instance, crystalline or amorphous aluminosilicates, silicon dioxide, hydrated silicic acid compound, clay compounds such as perlite and bentonite, and the like. It is preferable that the water-insoluble excipient has an average primary particle size of from 0.1 to 20 μm, from the viewpoint of the dispersibility in water.

The amount of the water-insoluble excipient is preferably 50% by weight or less, more preferably 30% by weight or less, of the base particles, from the viewpoints of economic advantages and the dispersibility.

7. Other Auxiliary Components

A fluorescer, a pigment, a dye or the like may be formulated in the base particles.

8. Preferable Combination

Among the compositions mentioned above, it is preferable that sodium carbonate/sodium sulfate/sodium polyacrylate are used in combination, and it is more preferable that sodium carbonate/sodium sulfate/sodium polyacrylate/sodium tripolyphosphate are used in combination, from the viewpoint of precipitating a larger amount of fine crystals, thereby enhancing the particle strength.

In addition, when base particles having a lower bulk density are prepared, it is preferable to add a surfactant in addition to the above-mentioned combination.

The base particles used in the present invention can be obtained by spray-drying a slurry prepared by adding the above components with mixing. The water content of the slurry and the spray-drying conditions are not particularly limited.

<Detergent Particles>

The "detergent particle" contained in the detergent particles of the present invention refers to a particle obtained by dry-neutralizing a base particle containing a water-soluble solid alkali inorganic substance (A) with a liquid acid precursor (B) of a non-soap anionic surfactant, and an aggregate thereof is referred to as "detergent particles."

1. Base Particles

The amount of the base particles in the detergent particles is not particularly limited. The amount of the base particles is preferably 40% by weight or more, more preferably 50% by weight or more, still more preferably 60% by weight or more, of the detergent particles, from the viewpoints of maintaining the particle size distribution and improving the dissolubility. On the other hand, the amount of the base particles is preferably 85% by weight or less, more preferably 75% by weight or less, of the detergent particles, from the viewpoint of the degree of freedom in the formulation.

2. Component (B): Liquid Acid Precursor of Non-Soap Anionic Surfactant

The component (B) of the detergent particles is formulated as the liquid acid precursor of a non-soap anionic surfactant, of which a part or all of the component (B) react with the component (A) in the base particles.

The liquid acid precursor of a non-soap anionic surfactant, which is the component (B), refers to a precursor of a non-soap anionic surfactant, which has an acidic form and is liquid, and is capable of forming a salt by the neutralization reaction. Therefore, the liquid acid precursor of the non-soap anionic surfactant is not particularly limited as long as it is a precursor of a known anionic surfactant having the above-mentioned characteristics. The liquid acid precursor of a non-soap anionic surfactant includes a linear alkylbenzenesulfonic acid (LAS), α-olefinsulfonic acid (AOS), an alkylsulfuric acid (AS), an internal olefinsulfonic acid, fatty acid esters of sulfonic acid, an alkyl ether sulfuric acid, a dialkyl sulfosuccinic acid and the like. The component (B) as mentioned above may be used as a single component or in admixture of two or more components. Among them, the linear alkylbenzenesulfonic acid (LAS) is preferable from the viewpoints of economic advantages, storage stability and foaming property.

The amount of the component (B) is preferably 10 parts by weight or more, more preferably 15 parts by weight or more, still more preferably 20 parts by weight or more, especially preferably 25 parts by weight or more, based on 100 parts by weight of the base particles, from the viewpoints of the detergency and the storage stability. On the other hand, the amount of the component (B) is preferably 80 parts by weight or less, more preferably 60 parts by weight or less, still more preferably 40 parts by weight or less, based on 100 parts by weight of the base particles, from the viewpoints of maintaining sharpness of the particle size distribution and suppressing the loss of dissolubility by the continuous phase of the neutralized product of the component (B).

In the present invention, it is preferable that the surface of the base particle is substantially coated with the non-soap anionic surfactant, from the viewpoint of the storage stability. The specific surface area increases when the bulk density is lowered, so that the preferable amount of the neutralized product of the component (B) also increases. If the surface of the base particle is not coated with the neutralized product of the component (B), there is a risk of generating blocking caused by the water-soluble inorganic salt on its surface.

3. Component (C): Fluidizing Aid

In the detergent particles of the present invention, the particle is subjected to surface modification with a fluidizing aid for the purpose of further improving the flowability and the storage stability of the detergent particle.

As the fluidizing aid, those known ones usually employable can be used, and sodium tripolyphosphate, a crystalline or amorphous aluminosilicate, diatomaceous earth, silica and the like can be preferably used. Among them, sodium tripolyphosphate and zeolite, each having a chelating ability, are preferable. By surface modifying the particle with a substance having a chelating agent, the chelating agent acts from the initial stage of washing, whereby improving the deterging performance. The zeolite is more preferable from the viewpoint of the flowability properties, and sodium tripolyphosphate is more preferable from the viewpoint of rinsing ability.

It is desired that the particle to be used as the fluidizing aid has an average particle size of one-tenth or less that of the average particle size of the detergent particles, from the viewpoint of coating ability.

In addition, when the amount of the fluidizing aid is too much or too little, the flowability properties are lowered. Therefore, the amount of the fluidizing aid is preferably from 2 to 20% by weight, more preferably from 5 to 15% by weight of the detergent particles.

When the zeolite is used as the fluidizing aid, it is preferable that the surface modification is carried out after the termination of the neutralization reaction from the viewpoint of suppression of the decomposition.

4. Other Components

The detergent particles of the present invention can be optionally formulated in proper amounts of the substances listed below.

(1) Inorganic Acid

When the base particles are mixed with the liquid acid precursor (B) of a non-soap anionic surfactant, an inorganic acid can be added for the purpose of reducing the adhesive property by the produced non-soap anionic surfactant. Preferable inorganic acids usable in the present invention include sulfuric acid and phosphoric acid, and a more preferable inorganic acid includes sulfuric acid.

The amount of the inorganic acid formulated is preferably from 0.3 to 1.0 mol, more preferably from 0.3 to 0.8 mol, still more preferably from 0.35 to 0.7 mol, per one mol of the component (B).

(2) Aqueous Alkali Solution

For the purpose of accelerating the dry-neutralization reaction, an aqueous alkali solution can be added to the base particles as a reaction initiator. The amount of the aqueous alkali solution added is preferably from 0.05 to 0.5 times the amount equivalent for neutralizing the liquid acid precursor (B) of the non-soap anionic surfactant, more preferably from 0.10 to 0.45 times the amount equivalent for neutralizing the liquid acid precursor, especially preferably from 0.15 to 0.40 times the amount equivalent for neutralizing the liquid acid precursor. The amount of the aqueous alkali solution is preferably 0.05 times or more of the amount equivalent for neutralizing the liquid acid precursor, from the viewpoint of initiating the neutralization reaction to give desired effects, and is preferably 0.5 times or less of the amount equivalent for neutralizing the liquid acid precursor, from the viewpoint of suppressing the aggregation of the detergent particle. The concentration of the aqueous alkali solution is not particularly limited. In order to suppress the dissolution of the base particles, the concentration of the aqueous alkali solution is preferably from 20 to 50% by weight, more preferably from 30 to 50% by weight, still more preferably from 40 to 50% by weight.

The kind of the aqueous alkali solution is not particularly limited. The aqueous alkali solution includes, for instance, aqueous strong-alkali solutions which easily cause neutralization reactions with the liquid acid precursor (B) of a non-soap anionic surfactant, such as an aqueous sodium hydroxide solution and an aqueous potassium hydroxide solution. Among them, the aqueous sodium hydroxide solution is preferred from the viewpoint of economic advantages. In addition, it is more preferable that the aqueous alkali solution has a pH of 12 or more.

(3) Water-Soluble Solid Alkali Inorganic Substance (A) For the purpose of accelerating the dry-neutralization reaction, the above-mentioned water-soluble solid alkali inorganic substance (A) can be added in a solid state as a reaction initiator. It is preferable that the component (A) is added as powder which is as fine as possible from the viewpoint of the reactivity, and it is more preferable that the component (A) is used together with the aqueous alkali solution.

The amount of the component (A) is preferably equal to or smaller than the amount equivalent for neutralizing the non-soap anionic surfactant, from the viewpoints of suppressing the inhibition of the reaction with the base particles and maintaining the particle size distribution.

(4) Surfactant

A surfactant which is liquid at an ambient temperature may be added, from the viewpoint of improving the detergency, within the range so as not to affect the storage stability and the flowability properties and not to increase the bulk density to be equal to or greater than the desired level. The surfactant includes, for instance, nonionic surfactants, such as polyoxyalkylene alkyl(8 to 20 carbon atoms) ethers, alkyl polyglycosides, polyoxyalkylene alkyl(8 to 20 carbon atoms) phenyl ethers, polyoxyalkylene sorbitan fatty acid(8 to 22 carbon atoms) esters, polyoxyalkylene glycol fatty acid(8 to 22 carbon atoms) esters, polyoxyethylene polyoxypropylene block polymers, and the like.

In addition, the surfactant which is liquid at an ambient temperature has an effect of lowering the viscosity of the non-soap anionic surfactant, thereby accelerating the penetration of the surfactant into the base particle. When the surfactant is added, the detergent particle has a controlled particle growth and improved granulation yield.

The amount of the surfactant which is liquid at an ambient temperature is preferably 10% by weight or less, more preferably 5% by weight or less, still more preferably 3% by weight or less, of the detergent particles, from the viewpoint of suppression of bleed-out and the foaming property. On the other hand, the amount of the surfactant is preferably 1% by weight or more, more preferably 2% by weight or more, from the viewpoint of acceleration of the penetration.

(5) Water

Water may be added to the detergent particle for the purpose of lowering the viscosity of the non-soap anionic surfactant, thereby accelerating the penetration of the surfactant into the base particle. The amount of water is preferably 1% by weight or more, more preferably 2% by weight or more, of the detergent particles, from the viewpoint of acceleration of the penetration. The amount of water is preferably 5% by weight or less, more preferably 3% by weight or less, of the detergent particles, from the viewpoint of suppression of excess granulation.

Also, this water may be used as water for dissolving the above inorganic salt and the surfactant.

The amount of the surfactant which is liquid at an ambient temperature is preferably 10% by weight or less, more preferably 5% by weight or less, still more preferably 3% by weight or less, of the detergent particles, from the viewpoints of suppression of bleed-out and foaming property.

<Detergent Composition>

The detergent composition of the present invention comprises separately added detergent components other than the detergent particles (for instance, fluorescers, enzymes, perfumes, defoaming agents, bleaching agents, bleaching activators, and the like). In this case, it is preferable that the detergent composition comprises the detergent particles according to the present invention in an amount of preferably 50% by weight or more, more preferably 60% by weight or more, still more preferably 80% by weight or more. Since the detergent composition has the above constitution, a detergent composition having excellent storage stability, dissolubility and sharp particle size distribution can be provided.

<Preparation Process of Detergent Particles>

The process for preparing detergent particles of the present invention is characterized in that the process comprises the steps of:

(a): preparing a slurry comprising a water-soluble solid alkali inorganic substance (A) in an amount equal to or greater than 4 times the amount equivalent for neutralizing a liquid acid precursor (B) of a non-soap anionic surfactant to be added in step (c); and (b): spray-drying the slurry obtained in step (a) to give base particles;

(c): mixing the liquid acid precursor (B) with the base particles obtained in step (b), and dry-neutralizing the resulting mixture.

Since the process for preparing detergent particles of the present invention comprises the above steps (a) to (c), there is an advantage that detergent particles having a sharp particle size distribution in a relatively small particle size range can be efficiently obtained.

The steps (a) to (c) will be described in detail hereinbelow.

1. Step (a)

In the step (a), it is important that the water-soluble solid alkali inorganic substance (A) is formulated so that the inorganic substance is finally made finer in the base particles, from the viewpoints of increasing the reaction rate and enhancing the particle strength. The process for making the water-soluble solid alkali inorganic substance (A) finer includes the following processes.

(1) Formulation as Dissolved Component

The water-soluble solid alkali inorganic substance (A) exists in the slurry in a dissolved state. In this case, the inorganic substance is formed into fine particles as the component (A) alone or a complex salt with other components during spray-drying.

(2) Precipitation of Crystals in Slurry

The dissolved water-soluble solid alkali inorganic substance (A) is precipitated by controlling the solubility of the component (A). The precipitated crystal may solely consists of the component (A) or form a complex salt with another component. In this case, it is preferable that the solubility is controlled by adding other water-soluble components in order to produce fine crystals. In addition, the addition of the polymer is also effective as a crystal-controlling agent in order to suppress the crystal from growing larger.

(3) Pulverization in Slurry

The crystals can be made finer by pulverizing coarse grains derived from raw materials, crystals of a complex salt reacted in coarse grain state and crystals of largely grown complex salt by the precipitation, with a wet-type pulverizer, such as line mills, colloidal mills and media mills.

By combining these processes (1) to (3), the water-soluble solid alkali inorganic substance can be formulated in the base particles in the form of fine particles. In order to sufficiently exhibit the reactivity in the base particles, the size of the fine particles in the above (2) and (3) is such that their average particle size in the slurry is preferably 50 μm or less, more preferably 30 μm or less, still more preferably 20 μm or less.

The conditions for the preparation of the slurry are not particularly limited as long as the base particles satisfy the above-described composition. In order to improve the particle strength of the base particles, it is desired to employ a preparation process which allows the precipitation of fine crystals in the slurry in a large amount. The fine crystal as referred to herein includes not only the crystal containing the water-soluble solid alkali inorganic substance (A) but also the crystal not containing an alkali, such as the crystal of sodium tripolyphosphate or the crystal of sodium sulfate.

The water content of the slurry is preferably 60% by weight or less, more preferably 55% by weight or less, from the viewpoint of the precipitation of the crystals. On the other hand, the water content of the slurry is preferably 40% by weight or more, more preferably 45% by weight or more, from the viewpoint of easy handling.

The preparation temperature of the slurry is preferably 30° C. or higher, more preferably 40° C. or higher, from the viewpoint of the solubility. On the other hand, the preparation temperature of the slurry is preferably 80° C. or lower, more preferably 70° C. or lower, from the viewpoint of the thermal stability.

In addition, the order of the addition of each of the components during the preparation of the slurry greatly affects the precipitation of the crystals. The order of the formulation for the preferable composition mentioned above is, for instance, the order of the formulation mentioned below.

sodium tripolyphosphate→sodium sulfate→sodium polyacrylate→sodium carbonate sodium sulfate→sodium tripolyphosphate→sodium polyacrylate→sodium carbonate sodium tripolyphosphate→sodium carbonate→sodium polyacrylate→sodium sulfate Besides the above, the fine crystals can be precipitated in a large amount by a process such as a process comprising making the temperature difference (ΔT) between the slurry and the jacket larger, or a process comprising applying a shearing force to the slurry with a line mill or the like during the preparation and/or after the preparation of the slurry.

Besides the method of precipitating fine crystals in a large amount, other components can be added from the viewpoints of the particle strength and the stabilization of the slurry. For instance, it is preferable that sodium silicate is firstly added from the viewpoint of enhancing the particle strength, and that sodium chloride is finally added from the viewpoint of stabilization of the slurry.

2. Step (b)

The step (b) comprises spray-drying the slurry obtained in step (a) to give base particles. The conditions for spray-drying the slurry obtained in the step (a) are not particularly limited, as long as the substances formulated in the slurry are not substantially affected, and spray-drying conditions generally carried out can be employable.

The spray-drying temperature is preferably from 150° to 300° C., more preferably from 170° to 250° C., from the viewpoints of improving the drying efficiency and suppressing the decomposition. On the other hand, as the device for carrying out spray-drying, a usually known spray-drying tower can be used. It is preferable that the exhaust air temperature of the spray-drying tower is adjusted to 80° to 130° C.

During the spray-drying in the present invention, it is important to obtain the base particle having a relatively small particle size with a sharp particle size distribution. For this purpose, it is important to select the nozzle type and its spraying pressure. For instance, the above-mentioned object can be achieved by using a single-fluid-type high-pressure nozzle.

3. Step (c)

The step (c) comprises mixing the liquid acid precursor (B) of a non-soap anionic surfactant with the base particles obtained in step (b), to carry out dry-neutralization. It is preferable that the component (B) is mixed as homogeneously as possible with the base particles.

As the process for adding the component (B), it is preferable that the component (B) is added as homogeneously as possible by spraying the component (B) with a nozzle. The temperature at which the component (B) is added is preferably from 40° to 80° C., more preferably from 50° to 70° C., from the viewpoint of the flowability.

The dry-neutralization temperature is preferably the higher the better, from the viewpoint of accelerating the reaction, and the dry-neutralization temperature is preferably from 60° to 80° C. On the other hand, the dry-neutralization temperature is the lower the better, from the viewpoints of delaying the reaction, and extending the mixed state with the liquid acid, thereby uniformly coating the surface of the particle, and the dry-neutralization temperature is preferably from 20° to 40° C.

Also, during the dry-neutralization, the aggregation of the detergent particles is likely to be generated because the component (B) becomes more viscous by the neutralization. A process for suppressing the aggregation includes a process comprising allowing air draft during the neutralization reaction, thereby lowering the adhesive property of the surface of the surfactant. Also, it is also effective to add an inorganic acid to the component (B), thereby forming an inorganic salt at the same time as the formation of the surfactant.

On the other hand, in order to accelerate the dry neutralization, the aqueous alkali solution or the water-soluble solid alkali inorganic substance (A) can be added to the base particles before the addition of the liquid acid.

In the step (c), it is preferable that the cutting power during the neutralization is reduced as much as possible in order to suppress the disintegration of the base particles during the dry neutralization. It is more preferable that only a mixing mechanism is used, and a cutting power by a cutting mechanism such as a chopper is not applied. The mixer in which the above-described cutting power is not applied includes, for instance, a Ribbon Mixer, a Nauta Mixer and the like. Even in a case where a device equipped with a cutting mechanism, such as a Lödige Mixer or a High-Speed Mixer, is used, the disintegration of the base particles can be suppressed by reducing a cutting power with a low-speed rotation of the chopper or without using the cutting mechanism. In addition, even if the cutting power were not applied, since the base particle comprises a water-soluble solid alkali inorganic substance in the form as fine as possible in an amount far exceeding the amount equivalent for neutralization, dry-neutralization can be easily carried out on the surface of the base particle.

4. Step (d)

It is preferable that the step comprising surface-modifying is carried out with a fluidizing aid [step (d)] in order to further improve the flowability properties and the storage stability of the detergent particle obtained in the step (c) of which surface is coated with the non-soap anionic surfactant.

The conditions for the surface modification are not particularly limited, and it is preferable that the fluidizing aid is distributed on the surface of the detergent particle as uniformly as possible.

The temperature in the device for surface modification is not particularly limited. It is preferable that the surface modification is carried out with cooling from the viewpoint of solidifying the surfactant.

The device for surface modification is preferably a device which can give a strong agitating power and cutting power at the same time, and modify the surface uniformly. As the device described above, a Lödige Mixer and a High-Speed Mixer are suitably used.

The properties of the base particles and the detergent particles of the present invention, and the methods for determining the properties thereof will be described hereinbelow.

<Properties of Base Particles>

One of the features of the present invention resides in that a base particle capable of rapidly reacting with a liquid acid precursor of a non-soap anionic surfactant, to fix the surfactant on its surface is provided. For this purpose, a large amount of the alkali is formulated, made finer and spray-dried. It is preferable that the particle after spray-drying satisfies the following properties.

The base particles have an average particle size of from 150 to 400 μm, preferably from 200 to 300 μm, from the viewpoints of the reactivity and the flowability.

The base particles have a particle strength of preferably 100 kg/cm$^2$ or more, more preferably 200 kg/cm$^2$ or more, from the viewpoint of suppression of the disintegration during the dry-neutralization.

The base particles have a water content of preferably 10% by weight or less, more preferably 5% by weight or less, still more preferably 3% by weight or less, from the viewpoints of easy handling and the storage stability.

In addition, the bulk density of the base particles is preferably the same as, or slightly lower than, that of the detergent particles, and it is desired that the bulk density is lower than the desired bulk density by 50 to 100 g/L or so. Here, when the surfactant which is liquid at an ambient temperature or water is used together, it is preferable that the bulk density is lower than the desired bulk density by 100 to 200 g/L or so.

<Properties of Detergent Particles>

It is preferable that the detergent particles in the present invention are prepared by dry-neutralization, while the particle size distribution and the shape of the base particles are maintained as much as possible. Therefore, the properties of the detergent particles are greatly affected by the properties of the base particles, and the desired detergent particles can be obtained by using the above-mentioned base particles.

Specifically, the detergent particles have an average particle size of preferably from 150 to 500 μm, more preferably from 180 to 300 μm, from the viewpoints of easy handling and the external appearance.

The detergent particles have a water content of preferably 10% by weight or less, more preferably 5% by weight or less, still more preferably 3% by weight or less, from the viewpoint of the storage stability.

Also, the detergent particles have a bulk density of preferably from 150 to 800 g/L, more preferably from 250 to 600 g/L, still more preferably from 300 to 500 g/L.

Among the detergent particles having these properties, detergent particles comprising a detergent particle in which the size of the above-mentioned base particle is retained are preferable. Here, the retention of the shape of the base particle is evaluated by the degree of particle growth of the detergent particle. The degree of particle growth is preferably from 0.9 to 1.6, more preferably from 0.9 to 1.4. The degree of particle growth can be determined by the following equation:

$$\text{Degree of Particle Growth} = \frac{\text{Average Particle Size of Final Detergent Particles}}{\text{Average Particle Size of Base Particles}}$$

The "final detergent particles" refer to particles obtained after dry neutralization or, when subjected to a surface modification step, particles obtained by the surface modification step.

<Methods for Evaluation of Properties>

The methods for determining the properties of the above-mentioned base particles or detergent particles are described below.

1. Bulk Density

The bulk density is measured by a method according to JIS K 3362.

2. Average Particle Size

The average particle size is measured by vibrating a sample for 5 minutes using standard sieves (sieve-openings: 2000 to 125 μm,) according to JIS Z 8801, and thereafter calculating the median size from a weight percentage according to the size openings of the sieves.

3. Particle Strength

The method for measuring the particle strength is as follows.

A cylindrical vessel of an inner diameter of 3 cm and a height of 8 cm is charged with 20 g of a sample, and the sample-containing vessel (manufactured by TSUTSUI RIKAGAKU KIKAI CO., LTD., "Model TVP1" tapping-type close-packed bulk density measurement device; tapping conditions: period 36 times/minute, free fall from a height of 60 mm) is tapped for 30 times. The sample height (an initial sample height) at that time is measured. Thereafter, an entire upper surface of the sample kept in the vessel is pressed at a rate of 10 mm/min with a pressing machine to take measurements for a load-displacement curve. The slope of the linear portion at a displacement rate of 5% or less is multiplied by an initial sample height, and the resulting product is divided by a pressed area, to give a quotient which is defined as the particle strength.

4. Average Particle Size of Fine Particles

As to the fine particles in the slurry, the average particle size can be determined, using, for instance, an FBRM system (manufactured by METTLER TOLEDO) without diluting the slurry.

When the FBRM system is used, 1 L of a slurry to be determined is supplied in a 1-L plastic cup, and a probe is inserted therein at an angle of 40 to 45° to the liquid surface and placed so that a determining surface of the probe does not appear above the liquid surface. Next, the slurry is agitated at 250 r.p.m. (r/min) using a propeller having a diameter of 6 cm, and the determination is made after confirming the determining surface of the probe is in the slurry. Incidentally, the plastic cup is kept in a water bath so as to have the same temperature as that the preparation temperature for the slurry.

5. Dissolubility

As the index for the dissolubility of the detergent particles in the present invention, there can be employed the 60-seconds dissolution ratio of the detergent particles. The dissolution ratio is preferably 90% or more, more preferably 95% or more. Incidentally, the dissolubility of the detergent composition can also be evaluated in the same manner.

The 60-seconds dissolution ratio of the detergent particles is calculated by the method described below.

A 1-L beaker (a cylindrical form having an inner diameter of 105 mm and a height of 150 mm, for instance, a 1-L glass beaker manufactured by Iwaki Glass Co., Ltd.) is charged with 1 L of hard water cooled to 5° C. and having a water hardness corresponding to 71.2 mg $CaCO_3$/L (a molar ratio of Ca/Mg: 7/3). With keeping the water temperature constant at 5° C. with a water bath, water is stirred with a stirring bar [length: 35 mm and diameter: 8 mm, for instance, Model "TEFLON SA" (MARUGATA-HOSOGATA), manufactured by ADVANTEC] at a rotational speed (800 r.p.m.), such that a depth of swirling to the water depth is about ⅓. The detergent particles which are accurately sample-reduced and weighed so as to be 1.0000 g±0.0010 g are supplied and dispersed in water with stirring, and stirring is continued. After 60 seconds from supplying the particles, a liquid dispersion of the detergent particles in the beaker is filtered with a standard sieve (diameter: 100 mm) having a sieve-opening of 74 μm as defined by JIS Z 8801 of a known weight. Thereafter, water-containing detergent particles remaining on the sieve are collected in an open vessel of a known weight together with the sieve. Incidentally, the operation time from the start of filtration to collection of the sieve is set at 10 sec±2 sec. The insoluble remnants of the collected detergent particles are dried for one hour in an electric dryer heated to 105° C. Thereafter, the dried insoluble remnants are cooled by keeping in a desiccator with a silica gel (25° C.) for 30 minutes. After cooling the insoluble remnants, a total weight of the dried insoluble remnants of the detergent, the sieve and the collected vessel is measured, and the dissolution ratio (%) of the detergent particles is calculated by Equation (1):

$$\text{Dissolution Ratio (\%)}=\{1-(T/S)\}\times 100 \quad (1)$$

wherein S is a weight (g) of the detergent particles supplied; and T is a dry weight (g) of insoluble remnants of the detergent particles remaining on the sieve when an aqueous solution prepared under the above stirring conditions is filtered with the sieve (drying conditions: maintaining at a temperature of 105° C. for 1 hour, and thereafter maintaining for 30 minutes in a desiccator (25° C.) containing silica gel).

6. Flowability Properties

The flow time is preferably 10 seconds or shorter, more preferably 8 seconds or shorter, still more preferably 7 seconds or shorter. The flow time refers to a time period required for cascading 100 mL of powder from a hopper used in a measurement of bulk density as defined in JIS K 3362.

<Method for Evaluating Qualities>

The methods for determining the qualities of the above-mentioned detergent particles are described below.

1. Caking Property (Storage Stability)

The caking property evaluated as the sieve permeability is preferably 90% or more, more preferably 95% or more. The testing method for caking property is as follows.

An open-top box having dimensions of 10.2 cm in length, 6.2 cm in width, and 4 cm in height is made out of a filter paper (No. 2, manufactured by ADVANTEC) by stapling the filter paper at four corners. A total weight of 15 g+250 g of an acrylic resin plate and a lead plate (or an iron plate) are placed on the box charged with a 50 g sample. The box is allowed to stand in a thermostat kept at a temperature of 30° C. and a humidity of 80%, and the caking state after for 7 days or 1 month is evaluated.

The evaluation is made by calculating the sieve permeability as follows.

(Sieve Permeability)

A sample obtained after the test is gently placed on a sieve (sieve opening: 4760 μm, as defined by JIS Z 8801), and the weight of the powder passing through the sieve is measured. The permeability based on the sample obtained after the test is calculated.

$$\text{Sieve Permeability (\%)} = \frac{\text{Weight (g) of Powder Passing Through Sieve}}{\text{Weight (g) of Whole Sample}} \times 100$$

2. Bleed-out Property

As to the bleed-out property of the detergent particles, it is preferable when the evaluation by the following test methods is preferably 2 rank or better, more preferably 1 rank. The testing method for bleed-out property is as follows: Bleed-out state of a surfactant is visually examined at bottom (side not contacting with powder) of the vessel made of the filter paper after the caking test. The evaluation of the bleed-out property is made based on the area of wetted portion occupying the bottom in the following 1 to 5 ranks. Incidentally, the state for each rank is as follows:

Rank 1: not wetted;

Rank 2: about ¼ of the bottom area being wetted;

Rank 3: about ½ the bottom area being wetted;

Rank 4: about ¾ of the bottom area being wetted; and

Rank 5: the entire bottom area being wetted.

3. Particle Size Distribution

As an index of the particle size distribution, the Rosin-Rammler number is calculated by fitting the 1410 μm-sievepassed detergent particles, to determine the particle size distribution. The Rosin-Rammler number (n) is calculated using the following equation:

$$\log(\log(100/R(Dp)))=n\log(Dp/De)$$

R (Dp): cumulative ratio [%] of powder having a particle size of Dp μm or more;

Dp: particle size [μm];

De: average particle size [μm]; and n: Rosin-Rammler number [−].

The larger the Rosin-Rammler number (n), the sharper the particle size distribution. n is preferably 2.0 or more, more preferably 2.5 or more, still more preferably 3.0 or more.

As described above, since the detergent particles of the present invention have excellent storage stability and dissolubility and a sharp particle size distribution, the detergent particles can be suitably used for detergent compositions for laundry items.

As described above, the preferred embodiments of the present invention are as follows:

[1] detergent particles obtained by a process comprising the step of dry-neutralizing base particles comprising a water-soluble solid alkali inorganic substance (A) with a liquid acid precursor (B) of a non-soap anionic surfactant, wherein the base particles are obtained by a spray-drying method, and wherein the base particles contain the component (A) in an amount of equal to or greater than 4 times the amount equivalent for neutralizing the component (B) and have an average particle size of from 150 to 400 μm;

[2] the detergent particles according to the above [1], further comprising a fluidizing aid (C);

[3] the detergent particles according to the above [1] or [2], wherein the amount of the component (B) is 15 parts by weight or more, based on 100 parts by weight of the base particles;

[4] base particles having an average particle size of from 150 to 400 μm, comprising 20 to 80% by weight of a water-soluble solid alkali inorganic substance;

[5] the base particles according to the above [4], further comprising a water-soluble inorganic salt;

[6] the base particles according to the above [4] or [5], further comprising a chelating agent;

[7] the base particles according to any one of the above [4] to [6], further comprising a polymer;

[8] the base particles according to any one of the above [4] to [7], further comprising a surfactant;

[9] the base particles according to any one of the above [4] to [8], wherein the particle strength is 100 g/cm$^2$ or more;

[10] a process for preparing detergent particles comprising the steps of:

(a): preparing a slurry comprising a water-soluble solid alkali inorganic substance (A) in an amount equal to or greater than 4 times the amount equivalent for neutralizing a liquid acid precursor (B) of a non-soap anionic surfactant to be added in step (c);

(b): spray-drying the slurry obtained in step (a) to give base particles; and (c): mixing the liquid acid precursor (B) with the base particles obtained in step (b) and dry-neutralizing the resulting mixture;

[11] the process for preparing detergent particles according to the above [10], wherein the base particles and the component (B) are mixed without applying a cutting power in the step (c);

[12] the process for preparing detergent particles according to the above [10] or [11], further comprising the step of:

(d): adding a fluidizing aid (C) to the detergent particles obtained in step (c), thereby surface-modifying the detergent particles; and

[13] a detergent composition comprising the detergent particles as defined in any one of the above [1] to [3].

EXAMPLE 1

<Preparation of Base Particles>

Base particles were prepared by the following procedures.

The amount 492.3 kg of water was added to a 1 m$^3$-mixing vessel having agitation impellers. After the water temperature reached 55° C., 128.9 kg of sodium tripolyphosphate and 211.3 kg of sodium sulfate were sequentially added thereto. The jacket was set at 45° C. After agitating the mixture for 10 minutes, 12.9 kg of a 40% by weight-aqueous sodium polyacrylate solution and 154.6 kg of sodium carbonate were added thereto, and the resulting mixture was then agitated for 60 minutes, with pulverizing under circulation in a line mill, to give a homogeneous slurry. The final temperature of this slurry was 50° C. In addition, the water content of this slurry was 50% by weight. Incidentally, the average particle size of fine particles present in this slurry was determined using an FBRM system. As a result, the average particle size was 28 μm.

This slurry was sprayed at a spraying pressure of 35 kg/cm$^2$ with a pressure spray nozzle arranged near the top of a spray-drying tower. A high-temperature gas fed to the spray-drying tower was supplied at a temperature of 240° C. to the bottom of the tower and exhausted at a temperature of 107° C. from the top of the tower. The composition and the properties of the resulting base particle are shown in Table 1. Incidentally, the base particle was directly observed with an SEM. As a result, fine particles were present in the base particle, as shown in FIG. 1.

<Preparation of Detergent Particles>

The amount 3.0 kg of the base particles obtained by the above-mentioned procedures were supplied into a Lödige Mixer (manufactured by Matsuzaka Giken Co., Ltd.; capacity: 20 L; equipped with a jacket), and the rotation of a main shaft was started at 70 r.p.m., without rotating a chopper. Incidentally, hot water at 80° C. was allowed to flow through the jacket at 10 L/minute. A mixed solution of 0.75 kg of an acidic form of LAS (liquid acid precursor of an anionic surfactant) and 0.06 kg of sulfuric acid, which was temperature-controlled to 60° C., was supplied into the above mixer in 1 minute, and the components were then mixed and agitated for 4 minutes to carry out a dry-neutralization reaction (the amount of the alkali in the base particles: 7.3 times the amount equivalent for neutralizing the anionic surfactant, 4.8 times the amount equivalent for neutralization by the acid).

Subsequently, 0.51 kg of a zeolite A-type was added thereto, and thereafter a surface modification was carried out with rotating the main shaft at 150 r.p.m. and the chopper at 3600 r.p.m., to give detergent particles. The composition, the properties and the quality of the resulting detergent particles are shown in Table 2. Incidentally, the degree of particle growth of the resulting detergent particles was 1.25.

The resulting detergent particles were particles which had an excellent dissolubility, a sharp particle size distribution and a low caking property.

EXAMPLE 2

<Preparation of Base Particles>

Base particles were prepared by the following procedures.

The amount 434.5 kg of water was added to a 1 $m^3$-mixing vessel having agitation impellers. After the water temperature reached 55° C., 178.6 kg of sodium sulfate and 127.6 kg of sodium tripolyphosphate were sequentially added thereto. The jacket was set at 45° C. After agitating the mixture for 10 minutes, 25.5 kg of a 40% by weight-aqueous sodium polyacrylate solution, 153.1 kg of sodium carbonate, 63.8 kg of 40% by weight-No. 2 Sodium Silicate, and 17.0 kg of 30% by weight-LAS-Na were added thereto, and the resulting mixture was then agitated for 60 minutes, with pulverizing under circulation in a line mill, to give a homogeneous slurry. The final temperature of this slurry was 52° C. In addition, the water content of this slurry was 50% by weight. Incidentally, the average particle size of fine particles present in this slurry was determined using an FBRM system. As a result, the average particle size was 27 μm.

This slurry was sprayed at a spraying pressure of 35 kg/$cm^2$ with a pressure spray nozzle arranged near the top of a spray-drying tower. A high-temperature gas fed to the spray-drying tower was supplied at a temperature of 242° C. to the bottom of the tower and exhausted at a temperature of 112° C. from the top of the tower. The composition and the properties of the resulting base particle are shown in Table 1. The base particle was directly observed with an SEM, as in Example 1. As a result, fine particles were present in the base particles.

<Preparation of Detergent Particles>

Thirty kilograms of the base particles obtained by the above-mentioned procedures were supplied into a Ribbon Mixer (manufactured by Fuji Paudal Co., Ltd.; whole capacity: 90 L; equipped with a jacket), and the rotation was initiated at a rotational speed of 67 r.p.m., with a Froude number of 0.85. Incidentally, hot water at 80° C. was allowed to flow through the jacket at 10 L/minute. The amount 7.5 kg of an acidic form of LAS, which was temperature-controlled to 60° C., was supplied thereinto in 1 minute, and the components were then mixed and agitated for 5 minutes to carry out a dry-neutralization reaction (the amount of the alkali in the base particles: 7.3 times the amount equivalent for neutralizing the anionic surfactant).

Subsequently, 2.5 kg of the above mixture and 0.34 kg of a zeolite A-type were supplied into a Lödige Mixer (manufactured by Matsuzaka Giken Co., Ltd.; capacity: 20 L; equipped with a jacket), and thereafter a surface modification was carried out with rotating the main shaft at 150 r.p.m. and the chopper at 3600 r.p.m., to give detergent particles. The composition, the properties and the quality of the resulting detergent particles are shown in Table 2. Incidentally, the degree of particle growth of the resulting detergent particles was 1.08.

The resulting detergent particles were particles which had an excellent dissolubility, a sharp particle size distribution and a low caking property.

EXAMPLE 3

<Preparation of Base Particles>

Base particles were prepared by the following procedures.

The amount 456.3 kg of water was added to a 1 $m^3$-mixing vessel having agitation impellers. After the water temperature reached 55° C., 92.9 kg of 40% by weight-No. 2 sodium silicate and 218.4 kg of sodium sulfate were sequentially added thereto. The jacket was set at 45° C. After agitating the mixture for 10 minutes, 46.5 kg of a 40% by weight-aqueous sodium polyacrylate solution and 185.9 kg of sodium carbonate were added thereto, and the resulting mixture was then agitated for 60 minutes, with pulverizing under circulation in a line mill, to give a homogeneous slurry. The final temperature of this slurry was 45.7° C. In addition, the water content of this slurry was 54% by weight. Incidentally, the average particle size of fine particles present in this slurry was determined using an FBRM system. As a result, the average particle size was 22 μm.

This slurry was sprayed at a spraying pressure of 35 kg/$cm^2$ with a pressure spray nozzle arranged near the top of a spray-drying tower. A high-temperature gas fed to the spray-drying tower was supplied at a temperature of 240° C. to the bottom of the tower and exhausted at a temperature of 107° C. from the top of the tower. The composition and the properties of the resulting base particle are shown in Table 1. The base particle was directly observed using an SEM, as in Example 1. As a result, fine particles were present in the base particles.

<Preparation of Detergent Particles>

The amount 2.5 kg of the base particles obtained by the above-mentioned procedures were supplied into a Lödige Mixer (manufactured by Matsuzaka Giken Co., Ltd.; capacity: 20 L; equipped with a jacket), and the rotation of a main shaft was started at 70 r.p.m., without rotating a chopper. Incidentally, hot water at 80° C. was allowed to flow through the jacket at 10 L/minute. The amount 0.78 kg of an acidic form of LAS (liquid acid precursor of an anionic surfactant), which was temperature-controlled to 60° C., was supplied into the above mixer in 1 minute, and the components were then mixed and agitated for 4 minutes to carry out a dry-neutralization reaction (the amount of the alkali in the base particles: 7.8 times the amount equivalent for neutralizing the anionic surfactant, 7.8 times the amount equivalent for neutralization by the acid).

Subsequently, 0.83 kg of a zeolite A-type was added thereto, and thereafter a surface modification was carried out with rotating the main shaft at 150 r.p.m. and the chopper at 3600 r.p.m., to give detergent particles. The composition, the properties and the quality of the resulting detergent particles are shown in Table 2. Incidentally, the degree of particle growth of the resulting detergent particles was 1.38.

The resulting detergent particles were particles which had an excellent dissolubility, a sharp particle size distribution and a low caking property.

EXAMPLE 4

<Preparation of Detergent Particles>

The amount 2.5 kg of the base particles obtained by the procedures in the above-mentioned Example 3 were supplied into a Lödige Mixer (manufactured by Matsuzaka Giken Co., Ltd.; capacity: 20 L; equipped with a jacket), and the rotation of a main shaft was started at 70 r.p.m., without rotating a chopper. Incidentally, hot water at 80° C. was allowed to flow through the jacket at 10 L/minute. The amount 0.73 kg of an acidic form of LAS (liquid acid precursor of an anionic surfactant), which was temperature-controlled to 60° C., was supplied into the above mixer in 1 minute, and the components were then mixed and agitated for 4 minutes to carry out a dry-neutralization reaction (the amount of the alkali in the base particles: 8.4 times the amount equivalent for neutralizing the anionic surfactant, 8.4 times the amount equivalent for neutralization by the acid).

Subsequently, 1.03 kg of pulverized sodium tripolyphosphate was added thereto, and thereafter a surface modification was carried out with rotating the main shaft at 150 r.p.m. and the chopper at 3600 r.p.m., to give detergent particles. The composition, the properties and the quality of the resulting detergent particles are shown in Table 2. Incidentally, the degree of particle growth of the resulting detergent particles was 1.33.

The resulting detergent particles were particles which had an excellent dissolubility, a sharp particle size distribution and a low caking property.

EXAMPLE 5

The amount 2.5 kg of the base particles obtained by the procedures in the above-mentioned Example 1 were supplied into a Lödige Mixer (manufactured by Matsuzaka Giken Co., Ltd.; capacity: 20 L; equipped with a jacket), and the rotation of a main shaft was started at 150 r.p.m., without rotating a chopper. Incidentally, hot water at 80° C. was allowed to flow through the jacket at 10 L/minute.

The amount 0.23 kg of a nonionic surfactant (EMULGEN 108 KM, manufactured by Kao Corporation), which was temperature-controlled to 60° C., was supplied into the above mixer in 1 minute, and the components were mixed and agitated for 1 minute. Next, 0.80 kg of an acidic form of LAS (liquid acid precursor of an anionic surfactant), which was temperature-controlled to 60° C., was supplied into the above mixer in 2 minutes, and the components were then mixed and agitated for 4 minutes to carry out a dry-neutralization reaction (the amount of the alkali in the base particles: 5.7 times the amount equivalent for neutralizing the anionic surfactant, 5.7 times the amount equivalent for neutralization by the acid).

Subsequently, 0.43 kg of a zeolite A-type and 0.30 kg of pulverized sodium tripolyphosphate were added thereto, and thereafter a surface modification was carried out with rotating the main shaft at 200 r.p.m. and the chopper at 2000 r.p.m., to give detergent particles. The composition and the properties of the resulting detergent particles are shown in Table 2.

The resulting detergent particles were particles which had an excellent dissolubility, a sharp particle size distribution and a low caking property.

EXAMPLE 6

<Preparation of Detergent Particles>

The amount 2.5 kg of the base particles obtained by the procedures in the above-mentioned Example 1 were supplied into a Lödige Mixer (manufactured by Matsuzaka Giken Co., Ltd.; capacity: 20 L; equipped with a jacket), and the rotation of a main shaft was started at 150 r.p.m., without rotating a chopper. Incidentally, hot water at 80° C. was allowed to flow through the jacket at 10 L/minute.

The amount 0.23 kg of a nonionic surfactant (EMULGEN 108 KM, manufactured by Kao Corporation) and 0.05 kg of water, which were temperature-controlled to 60° C., were supplied into the above mixer in 1 minute, and the components were then mixed and agitated for 1 minute. Next, 0.80 kg of an acidic form of LAS (liquid acid precursor of an anionic surfactant), which was temperature-controlled to 60° C., was supplied into the above mixer in 2 minutes, and the components were then mixed and agitated for 4 minutes to carry out a dry-neutralization reaction (the amount of the alkali in the base particles: 5.7 times the amount equivalent for neutralizing the anionic surfactant, 5.7 times the amount equivalent for neutralization by the acid).

Subsequently, 0.43 kg of a zeolite A-type and 0.25 kg of pulverized sodium tripolyphosphate were added thereto, and thereafter a surface modification was carried out with rotating the main shaft at 200 r.p.m. and the chopper at 2000 r.p.m., to give detergent particles. The composition and the properties of the resulting detergent particles are shown in Table 2.

The resulting detergent particles were particles which had an excellent dissolubility, a sharp particle size distribution and a low caking property.

TABLE 1

| | Ex. 1 | Ex. 2 | Ex. 3 | Ex. 4 | Ex. 5 | Ex. 6 |
|---|---|---|---|---|---|---|
| Composition of Base Particles (% by weight) | | | | | | |
| Component (A) | | | | | | |
| Sodium Carbonate | 30 | 30 | 40 | 40 | 30 | 30 |
| Others | | | | | | |
| Sodium Tripolyphosphate | 25 | 25 | 0 | 0 | 25 | 25 |
| Sodium Sulfate | 41 | 35 | 47 | 47 | 41 | 41 |
| LAS-Na | 0 | 1 | 0 | 0 | 0 | 0 |
| Sodium Polyacrylate | 1 | 2 | 4 | 4 | 1 | 1 |
| No. 2 Sodium Silicate | 0 | 5 | 8 | 8 | 0 | 0 |
| Water | 3 | 2 | 1 | 1 | 3 | 3 |
| Properties of Base Particles | | | | | | |
| Bulk Density [g/L] | 580 | 381 | 447 | 447 | 580 | 580 |
| Average Particle Size [μm] | 269 | 294 | 231 | 231 | 269 | 269 |
| Particle Strength [g/cm$^2$] | 238 | 150 | 125 | 125 | 238 | 238 |

TABLE 2

| | Ex. 1 | Ex. 2 | Ex. 3 | Ex. 4 | Ex. 5 | Ex. 6 |
|---|---|---|---|---|---|---|
| Composition of Detergent Particles (parts by weight) | | | | | | |
| Base Particles | 100 | 100 | 100 | 100 | 100 | 100 |
| Component (B) Liquid Acid Precursor | | | | | | |
| Acid Form of LAS | 25 | 25 | 31 | 29 | 32 | 32 |
| Others | | | | | | |
| Sulfuric Acid | 2 | 0 | 0 | 0 | 0 | 0 |
| Nonionic Surfactant | 0 | 0 | 0 | 0 | 9 | 9 |
| Water | 0 | 0 | 0 | 0 | 0 | 2 |
| Component (C) | | | | | | |
| Zeolite A-type | 17 | 17 | 33 | 0 | 17 | 17 |
| Sodium Tripolyphosphate | 0 | 0 | 0 | 41 | 12 | 10 |

TABLE 2-continued

| | Ex. 1 | Ex. 2 | Ex. 3 | Ex. 4 | Ex. 5 | Ex. 6 |
|---|---|---|---|---|---|---|
| Production Efficiency | | | | | | |
| Proportion of Particles Having Size of 1410 μm or less [% by weight] | 91 | 95 | 95 | 92 | 91 | 93 |
| Properties of Detergent Particles | | | | | | |
| Bulk Density [g/L] | 587 | 446 | 526 | 490 | 680 | 710 |
| Average Particle Size [μm] | 336 | 317 | 319 | 306 | 303 | 288 |
| 60-seconds Dissolution Rate [%] | 95 | 96 | 98 | 96 | 94 | 96 |
| Flowability [s] | 6.2 | 6.4 | 5.9 | 6.3 | 6.3 | 6.2 |
| Quality of Detergent Particles | | | | | | |
| Rosin-Rammler Number [—] | 3.14 | 3.34 | 2.63 | 2.76 | 2.53 | 2.61 |
| Sieve Permeability [%] (after 7 days) | 100 | 100 | 100 | 100 | 100 | 100 |
| Bleed-out Property [—] | 1 | 1 | 1 | 1 | 1 | 1 |

INDUSTRIAL APPLICABILITY

Since the detergent particles of the present invention have excellent storage stability and dissolubility, and a sharp particle size distribution, there is exhibited an effect that detergent compositions which are suitably used for laundry detergents can be obtained by using the above detergent particles. The detergent particles of the present invention are suitable for laundry detergents, dishwashing detergents and the like.

The invention claimed is:

1. A process for preparing detergent particles comprising the steps of:

(a): preparing a slurry comprising a water-soluble solid alkali inorganic substance (A) in an amount equal to or greater than 4 times the amount equivalent for neutralizing a liquid acid precursor (B) of a non-soap anionic surfactant to be added in step (c), and a zeolite in an amount of 10% by weight or less;

(b): spray-drying the slurry obtained in step (a) to give base particles; and (c): mixing the liquid acid precursor (B) with the base particles obtained in step (b), wherein the amount of (B) is 25 parts by weight or more, based on 100 parts by weight of the base particles, and dry-neutralizing the resulting mixture, wherein the detergent particles have a bulk density of 150 to 446 g/L.

2. The process according to claim 1, wherein said base particles of step (b) have an average particle size of from 150 to 400 μm, and comprise 20 to 80% by weight of the water-soluble solid alkali inorganic substance (A).

3. The process for preparing detergent particles according to claim 1, further comprising the step of:

(d) adding a fluidizing aid (C) to the detergent particles obtained in step (c), thereby surface-modifying the detergent particles.

4. The process according to claim 1, wherein the base particles have 20% to 80% by weight of component (A).

5. The process according to claim 1, wherein the detergent particles have 10% by weight or less of nonionic surfactants.

* * * * *